US006036401A

United States Patent [19]

Morina et al.

[11] Patent Number: 6,036,401

[45] Date of Patent: Mar. 14, 2000

[54] ROADWAY ACCESS DEVICE AND METHOD OF USING SAME

[76] Inventors: John Morina, 1003 S. Pearl St., Centralia, Wash. 98531; Chester Ryan, 349 Bartlett St., Manchester, N.H. 03102

[21] Appl. No.: 09/069,096

[22] Filed: Apr. 29, 1998

[51] Int. Cl.[7] ..... E03B 9/10

[52] U.S. Cl. ..... 404/26; 52/20; 137/370; 137/371

[58] Field of Search ..... 52/20; 404/25, 404/26; 137/364, 365, 367, 371, 370

[56] References Cited

U.S. PATENT DOCUMENTS

| | | | |
|---|---|---|---|
| 406,253 | 7/1889 | Bingham . | |
| 3,537,471 | 11/1970 | Houle | 137/370 |
| 4,064,902 | 12/1977 | Swenson | 137/370 |
| 4,075,796 | 2/1978 | Cuozzo | 52/20 |
| 4,239,056 | 12/1980 | Shope | 137/370 |
| 4,325,405 | 4/1982 | Christo | 137/371 |
| 4,337,005 | 6/1982 | LeBaron | 404/26 |
| 4,702,275 | 10/1987 | Ballun et al. | 137/556 |
| 4,726,490 | 2/1988 | Bonnema et al. | 220/307 |
| 4,874,105 | 10/1989 | Tetreault | 220/4 |
| 5,095,667 | 3/1992 | Ryan et al. | 52/20 |
| 5,209,601 | 5/1993 | Odill et al. | 404/26 |
| 5,220,942 | 6/1993 | Garvin, Jr. et al. | 137/556 |
| 5,249,697 | 10/1993 | McKinnon | 220/484 |
| 5,329,971 | 7/1994 | Condon | 138/89 |
| 5,333,750 | 8/1994 | McKinnon | 220/484 |
| 5,344,253 | 9/1994 | Sacchetti | 404/26 |
| 5,362,174 | 11/1994 | Yang | 404/25 |
| 5,375,730 | 12/1994 | Bahr et al. | 220/324 |
| 5,525,007 | 6/1996 | Jones et al. | 405/52 |
| 5,555,998 | 9/1996 | Coppola | 220/484 |
| 5,577,531 | 11/1996 | Hayden et al. | 137/369 |
| 5,634,488 | 6/1997 | Martin, Jr. | 137/370 |
| 5,671,772 | 9/1997 | Bliss | 137/370 |

FOREIGN PATENT DOCUMENTS

| | | | |
|---|---|---|---|
| 3103264 | 8/1982 | Germany | 137/370 |
| 4-238920 | 8/1992 | Japan | 29/12 |
| 5-222737 | 8/1993 | Japan | 29/12 |
| 2134575 | 8/1984 | United Kingdom | 29/12 |
| WO 91/16504 | 10/1991 | WIPO | 29/14 |

*Primary Examiner*—James A. Lisehora
*Attorney, Agent, or Firm*—Richard C. Litman

[57] ABSTRACT

A roadway access device such as manhole cover, a storm drain, or a utility valve box which facilitates road paving and grinding operations. The access device includes a riser assembly having an inverted frustoconical top portion that minimizes frictional engagement between the riser and the paved surface and permits repositioning in an elevated plane with no excavation necessary. There is a tapered upper portion that engages with an internally threaded extension nut with tool-engaging receptors and when the nut extension is rotated, the upper conical portion does not rotate, but displaces vertically. There is a riser member that is externally threaded and fixed in position relative to the rest of the assembly around which the extension nut rotates in order to vertically displace the access device. Additionally, there are separate removable lids constructed of high strength material which can be put in place during paving and grinding operations and easily removed when operations are complete. The riser assembly couples with an extended valve nut adapter which provides a housing for an existing valve nut extension which is capable of responding to an applied vertical load, and climatic changes by axial displacement and will provide protection for the valve nut extension from debris and natural elements.

21 Claims, 11 Drawing Sheets

ROADWAY ACCESS DEVICE AND METHOD OF USING SAME

BACKGROUND OF THE INVENTION

1. Field of the Invention

The present invention relates generally to roadway access devices and more particularly, to improved utility valve boxes, manholes and storm drains enabling ready vertical adjustment of the access devices and easy access to utility valves.

2. Description of the Related Art

Roads are periodically resurfaced due to the wearing away of the surface of the road by the constant passing of traffic. This resurfacing of a road usually raises the road height approximately 2 inches. Roadway access devices, including manholes and storm drains, which are within the area of a road surface have to be raised at some point either before or after resurfacing the road.

The common procedure in the preparation of roadway access devices for resurfacing begins with removal of sufficient amount of the road composition surrounding the installed device. This necessitates the use of a jackhammer along with its compressor apparatus and entails a very time consuming operation as the entire periphery of the access device must be cleared of contact with the road material; many access devices are several inches high thus requiring large amounts of material to be removed around them. This process is required when either replacing the existing access device with a different model or, before installing adaptor means or manipulating adjustment means to permit elevation of the same access device.

After provision is made to modify the plane of the access device and its associated lid or cover, the readjusted assembly is often sealed in place with concrete in order to fix it in its new position and to permit replacement of road material that had to be removed. It is not uncommon for the repositioning of a large access device to require up to three men and their heavy equipment and three hours' labor before the road is ready to be resurfaced.

In view of the labor and time now required to prepare existing access devices for a resurfacing job, the public is often subjected to at least protracted inconvenience and, frequently, less than safe driving conditions. This is evident when one considers that the time required to reposition the access devices throughout a repaving job of several miles can very well result in many of the repositioned access devices remaining in an exposed elevated condition for some time before repaving occurs.

There are currently three main methods for dealing with roadway access devices during paving projects. The first, primarily used in the eastern United States, involves raising the units prior to paving. The second method, used primarily in the west, involves raising the units after paving the road. The third method, used to deal with excessive asphalt buildup, involves lowering the road surface by grinding.

The fundamental problem with the first method is that the access devices are exposed for extended periods of time and suffer the daily pounding of normal vehicle traffic. This traffic often damages the access devices, resulting in the need to replace them at a significant cost.

The second method eliminates the problem of damaging the access devices prior to paving, but brings about the problem of locating the access devices following completion of the paving. Several contractors have tried to avoid this problem by measuring the location of the access devices prior to paving in order to easily expose them later. However, inaccurate measurements lead to far more destruction of the newly paved surface than is desirable. Even in the event the access devices were discovered easily after paving, the contractor would still be required to eliminate large amounts of asphalt to expose enough of the access device in order to raise it using existing methods.

Finally, the street grinding method causes problems similar to raising the access devices prior to paving (i.e. potential damage to the access devices) as well as problems related to the grinding method itself. The grinding tool can actually damage the valve boxes or can be damaged itself. To prevent this from happening, the grinder must be frequently raised and lowered which results in lengthy and costly operations. Additionally, once the grinding is completed, the remaining asphalt around the access devices must be removed manually.

Utility companies also encounter difficulties when people either accidentally or purposely tamper with their valves. Additionally, the utility companies often encounter difficulties in identifying the specifications of their own utility lines and it often requires much effort to discover necessary information.

Furthermore, existing utility valve boxes generally have an opening to provide access to the utility valve below. However, the valve is usually situated well below the surface of the road, making access difficult. Extended valve nuts have been created which raise the valve nut above its existing level. However, problems arise when a heavy load passes over the valve box, because the load is subsequently displaced to the utility line increasing the risk of damage. Additionally, natural elements and debris have a negative effect on valve nut operation.

What is desirable in the adjustment of devices such as manholes, storm drains or valve boxes is a minimal amount of necessary equipment or required use of force and time to alter its vertical position. Another desirable feature is to completely eliminate the excavation that has to be done to clear the device from the surrounding pavement so that it can be repositioned. Additionally, a desirable feature is that no matter which of the three methods described is used to resurface the road, there will be no interruptions to efficient paving operations. Another desirable feature would be a means of identification of the specifications of the valve contained beneath the valve box (i.e. location, valve type, pipeline pressure, material type and pipe size). Finally, a desirable feature would be a way of easily accessing valve nuts contained beneath utility valve boxes whereby the means of doing so would not cause undue loads to be placed on utility valves and piping systems while also keeping out unwanted debris and natural elements. Thus, a combination of these features can save many valuable man-hours and expense in the resurfacing of roads, sidewalks and the like. Every year, over three million of these access devices are raised with the average cost being about $300.00 per unit.

Numerous prior art devices have sought to address the issue of adjusting the height of roadway access devices. U.S. Pat. No. 5,095,667 issued on Mar. 17, 1992 to Ryan et al. discloses a telescopic manhole and storm drain installation which is conically shaped and utilizes a threaded vertical member to raise and lower the riser. The vertical adjustment of the riser is accomplished through the rotation of an externally threaded vertical riser member which is threadedly coupled with an internally threaded collar. The force that acts on the external threads of the riser is too great to be easily overcome.

U.S. Pat. No. 5,344,253 issued on Sep. 6, 1994 to Sacchetti discloses a telescoping manhole cover that is raised or lowered by adjusting a plurality of threaded bolts within the apparatus. The weight of the riser, as well as loads applied thereto is transferred to the threaded bolts. Additionally, in order for any adjustment to be made, excavation of the surrounding material would have to be performed. However, unlike the '253 invention, the weight of the riser and loads applied to the present invention are transmitted to a conical riser surface supported by surrounding fixed material such as concrete or asphalt, as will be better understood later.

World Patent No. 91/16504 issued on Oct. 31, 1991 to Kofel describes a vertically adjustable manhole cover which has two tubular elements threadedly engaged for vertical adjustment of the top portion. Again, the weight of the top portion and the loads applied thereto will be distributed to the threads and interlocking teeth of the adjustment assembly. Additionally, the top surface of the upper portion of the assembly is flush with the surface of the road. For any adjustment to be made, major excavation would have to be performed.

U.S. Pat. No. 4,337,005 issued on Jun. 29, 1982 to LeBaron taught the use of ring spacers to vertically alter the height of the riser, but a hoist means is necessary to raise the assembly in order to put the rings in place. Additionally, excavation of the surrounding material must be performed prior to raising the unit. It would be extremely difficult to get precise height adjustments using the method taught in LeBaron.

U.S. Pat. No. 4,325,405 issued on Apr. 20, 1982 to Christo discloses a valve box assembly having a valve box and a riser threadedly mounted in the valve box. The threads of the riser are external to the riser and therefore engage too great a frictional force in order to be turned easily. The external threads will collect dirt and debris which will prevent the unit from being raised. Further, because the unit has a protruding flange, excavation must be performed prior to raising the height of the device.

U.S. Pat. No. 5,209,601 issued on May 11, 1993 to Odill et al. discloses a manhole grade adjusting ring. Essentially, the ring is placed inside an existing manhole opening to raise the height of the manhole. The height adjustment of this device is determined by the manufactured height of the insert, thereby limiting field adjustment to the preset dimensions. The Patent to Odill does not teach the use of a threaded member for raising and lowering the height of the manhole or valve box as in the present invention.

U.S. Pat. No. 5,555,998 issued on Sep. 17, 1996 to Coppola discloses a removable lid for a gate valve which engages a bolt which extends through the pipe that the lid rests on. The drawback of the invention disclosed in Coppola is that the lid is easily removed by someone without authorized access.

Several patents disclose valve boxes or modifications thereof, but do not teach any means of adjusting the device. These include U.S. Pat. No. 4,874,105 (Valve Box) issued on Oct. 17, 1989 to Tetreault; U.S. Pat. No. 5,249,697 (Meter Pit) issued on Oct. 5, 1993 to McKinnon; U.S. Pat. No. 5,329,971 (Closet Flange Test Plug) issued on Jul. 19, 1994 to Condon; U.S. Pat. No. 5,525,007 (Sewer Construction) issued on Jun. 11, 1996 to Jones et al.; U.S. Pat. No. 5,333,750 (Durable Lightweight Meter Box) issued on Aug. 2, 1994 to McKinnon; and U.K. Patent No. 2,134,575A (Combined stop-cock chamber and surface box) issued on Aug. 15, 1994 to Evans.

A telescopic manhole assembly is described in U.S. Pat. No. 4,075,796 issued on Feb. 28, 1978 to Cuozzo and wherein vertical adjustment of the riser is achieved by rotating the assembly comprising a threaded flange. Cuozzo further illustrates cut-out portions or bores for a tool or locking member, but these are located at the top of a single, vertically walled riser sleeve. Additionally, once new pavement is added around the raised unit, subsequent adjustments require removal of the pavement before the unit can be moved.

Numerous patents have also addressed the idea of extended valve housings to make valve nut access easier. U.S. Pat. No. 3,537,471 issued on Nov. 3, 1970 to Houle discloses a valve extension assembly which allows the housing to telescope in response to a vertical loading for initial installation only. The invention in Houle does not teach a means for connecting the valve extension assembly to a utility valve box as described in the present invention; it is simply a means of directly accessing the valve beneath the sidewalk surface and is not capable of supporting massive loads as is the present invention.

U.S. Pat. No. 5,671,772 issued on Sep. 30, 1997 to Bliss discloses a vertically adjustable valve box for providing access to underground utility valves which comprises a housing which telescopes during initial installation and covers the utility valve and merely allows access to the valve by a long, cumbersome valve key. Access to the valve nut itself is not simplified in any way. Additionally, the invention in Bliss does not provide protection for the valve and is not coupled to a utility valve box which is capable of withstanding potentially great pressures.

Several patents have issued concerning valve housings which couple with valve utility boxes. In these patents, unlike the present invention, the valve remains far below the valve box and the housings merely provide a channel through which a serviceman could guide his tools. In addition, these inventions require significant excavation to raise the housing for pavement height changes. These include U.S. Pat. No. 5,634,488 (Modular Valve Service Box) issued on Jun. 3, 1997 to Martin, Jr.; U.S. Pat. No. 4,239,056 (Valve Service Box Having Means For Servicing Different Sized Valves Against Rotation) issued on Dec. 16, 1980 to Shope; Japanese Patent 4,238,920 (Duct Sleeve for Increased Port of Manhole) issued in August 1992 to Motoyuki Koga; and Japanese Patent 5,222,737 (Manhole Device of Underground Tank) issued in August 1993 to Yasuki Wada.

Several patents have issued concerning the general field of valve nut extensions, but not specifically housings for the valve nut extensions that couple to the utility valve box as in the present invention. These include U.S. Pat. No. 5,577,531 (Flood Protection Sewer Backflow Control Valve and Adapter Assembly) issued on Nov. 26, 1996 to Hayden et al.; U.S. Pat. No. 5,220,942 (Extensible Indicator Post for Valve Assemblies) issued on Jun. 22, 1993 to Garvin, Jr. et al.; U.S. Pat. No. 4,702,275 (Post Assembly for a Buried Valve) issued on Oct. 27, 1987 to Ballun et al.; U.S. Pat. No. 4,064,902 (Curb Box) issued on Dec. 27, 1977 to Swenson; U.S. Pat. No. 5,375,730 (Unloading valve for Hopper Car) issued on Dec. 27, 1994 to Bahr et al.; and German Patent No. 3,103,264 issued in August 1982.

Patents have disclosed lids for manholes and valve boxes, but are unlike the present invention. These include U.S. Pat. No. 4,726,490 (Safety Lid) issued on Feb. 23, 1988 to Bonnema et al.; U.S. Pat. No. 5,362,174 (Manhole Cover) issued on Nov. 8, 1994 to Yang.

None of the prior inventions known to the inventor in the field of valve nut height extensions incorporate a means of retaining necessary utility wires in order to prevent them from being pinched during servicing of the valve box device or the telescoping motion of the housing, thus resulting in costly repairs.

None of the above inventions and patents, taken either singularly or in combination, is seen to describe the instant invention as claimed. Thus a telescopic roadway access device solving the aforementioned problems is desired.

SUMMARY OF THE INVENTION

Accordingly, it is a principal object of the invention to provide an improved roadway access device installation including a riser assembly having an inverted conical top portion that minimizes frictional engagement between the riser and the surrounding material and permits repositioning in an elevated plane with no excavation necessary.

It is another object of the invention to provide an improved roadway access device assembly having an upper funnel portion that engages with an internally threaded extension nut with tool-engaging means therein in such a way that when the extension nut is rotated, the upper conical portion does not rotate.

It is a further object of the invention to provide an improved roadway access device assembly having a riser member that is externally threaded and fixed in position relative to the rest of the assembly.

Still another object of the invention is to provide an improved roadway access device including a riser assembly and lid constructed of synthetic polymeric material such as nylon and provided with cooperating threaded connection means, an angular ribbed means for channeling the lid in and out of position within access device, and a labyrinth seal.

Another object of the invention is to provide an improved roadway access device including a riser assembly and a removable lid constructed of synthetic polymeric material with the lid base defining a concave configuration with a honeycomb structure providing transmission of imposed loads to the side wall of the riser assembly. The lid comprises a lower structural component and a cover of the same material which is removably coupled thereto in order to facilitate replacement of the worn top cover and eliminate the need to replace the entire lid.

A further object of the invention is to provide an improved roadway access device whereby the riser assembly can be quickly removed prior to street grinding operations and an additional removable lid constructed of high strength material which can be put in place during the grinding operations and easily removed when operations are complete, thereby preventing asphalt from filling in the void created when the riser is removed.

Still another object of the present invention is to provide an improved telescopic utility valve box which includes a riser assembly which couples with an extended valve nut adapter which provides a housing for an existing valve nut extension providing spring tension sufficient to support the weight of the riser assembly during initial installation and is capable of responding to an applied vertical load, and climatic changes by axial displacement and will provide protection for the valve nut extension from debris and natural elements.

It is a further object of the present invention to provide a method of paving a road surface which allows flawless detection of roadway access devices which have been paved over.

It is an object of the invention to provide improved elements and arrangements thereof for the purposes described which is inexpensive, dependable and fully effective in accomplishing its intended purposes.

These objects are met by the present invention comprising a roadway access device which facilitates road paving and grinding operations. The device includes a riser assembly having an inverted frustoconical top portion that minimizes frictional engagement between the riser and the paved surface and permits repositioning in an elevated plane with no excavation necessary. There is a tapered upper portion that engages with an internally threaded extension nut with tool-engaging receptors and when the nut extension is rotated, the upper conical portion does not rotate, but displaces vertically. There is a riser member that is externally threaded and fixed in position relative to the rest of the assembly around which the extension nut rotates in order to vertically displace the access device.

Additionally, there is a separate removable paving lid constructed of high strength material which can be put in place during paving operations and easily removed when operations are complete. The riser assembly couples with an extended valve nut adapter which provides a housing for an existing valve nut extension which is capable of responding to an applied vertical load, and climatic changes by axial displacement and will provide protection for the valve nut extension from debris and natural elements.

The above stated and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
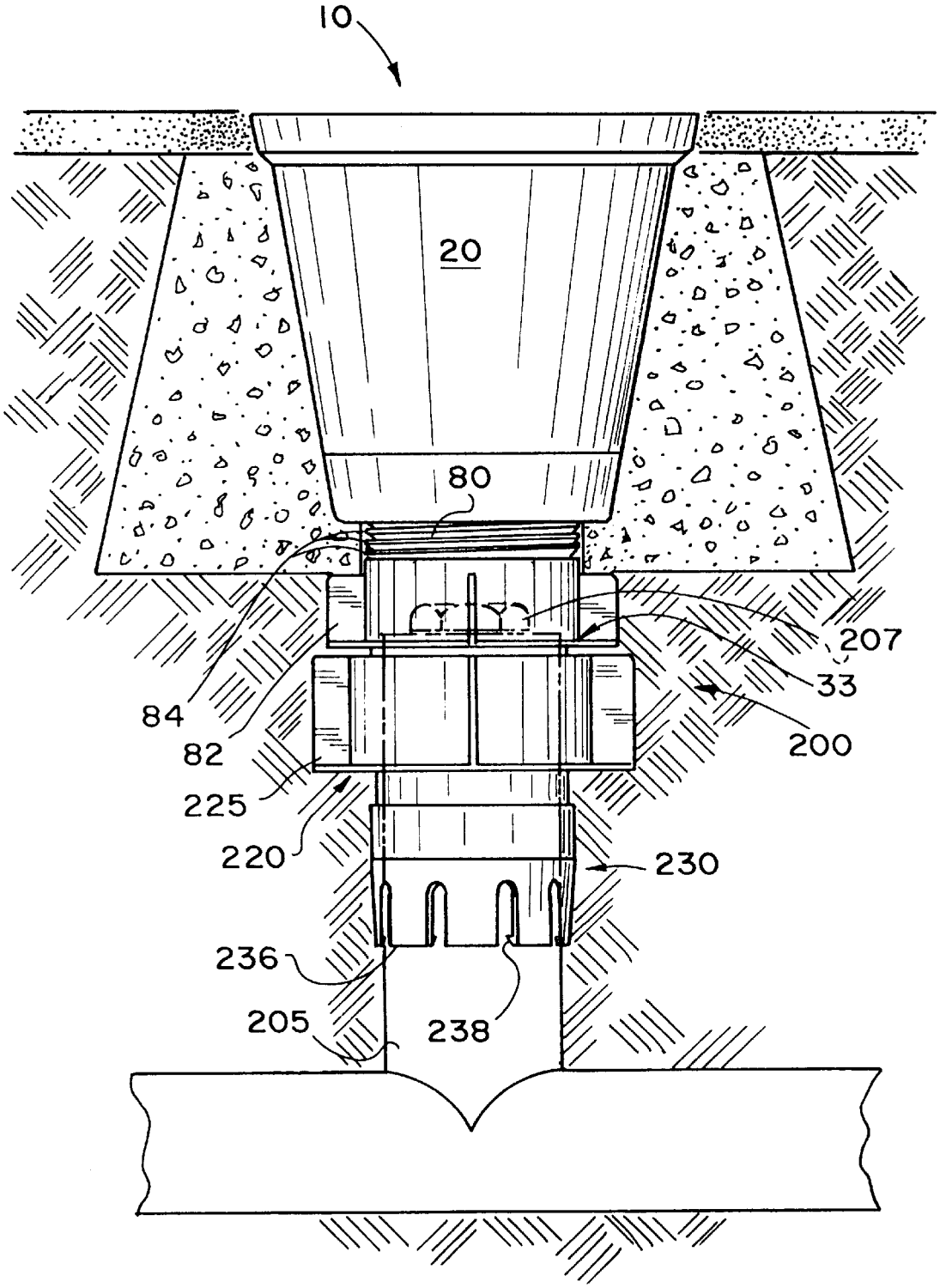
FIG. 1 is a vertical side elevation of a telescopic utility valve box with an extended valve nut adapter according to the present invention.

The present invention will be understood to relate to an improved roadway access device such as a manhole cover, storm drain or a utility valve box, generally designated 10 and which includes a fixed, externally threaded cylindrical riser member 80, adapted to cooperate with an internally threaded rotatable extension nut 50 by means of thread 58. The access device 10 is provided with a funnel 20 which is comprised of an upper funnel section 30 which is coupled on its bottom edge 37 with an end cap 34, and is placed around the extension nut 50, which allows the funnel 20 to be displaced vertically when the extension nut 50 is rotated.

The funnel 20 of the access device 10 comprises an upper funnel section 30 which is coupled with an end cap 34, with a thrust washer 25 therebetween. The end cap 34 has two diametrically opposed tongues 36 extending inwardly perpendicular from its inner surface 35 that will prevent the funnel 20 from rotating as described below. The funnel section 30 forms an open ended body having, first, an internal wall 29 forming a vertical reference plane relative to the ground when installed and, second, a continuous side wall 31 which is inclined outwardly from its bottom edge 37 to its top edge 39 such that a generally inverted frustoconical configuration is defined. The inclination, which is at least 5 degrees from the vertical plane, provides an important aspect of the invention as will be appreciated hereinafter. Between walls 29 and 31 exist a plurality of spaced support ribs 32, preferably sixteen ribs equidistantly spaced about the circumference of wall 29 which thereby forms an internal structural support webbing.

Figure 2:
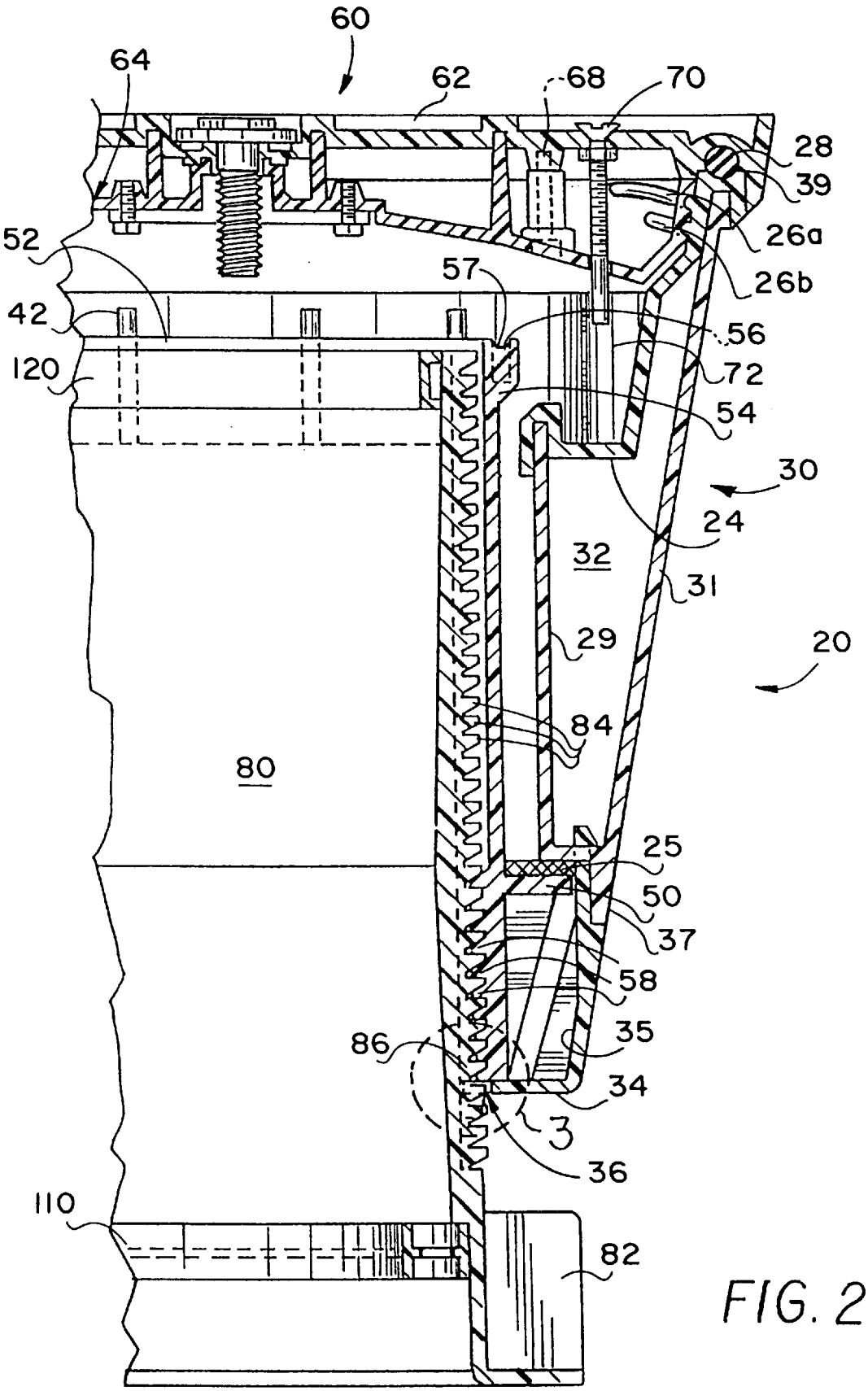
FIG. 2 is a partial sectional view of the roadway access device according to the present invention.

The area adjacent the top edge 39 of the funnel is angled as best seen in FIG. 2 to form a seat and groove for the lid 60. The lid top edge 60 forms a rim adapted to be disposed in a plane which is coplanar with the top surface of the pavement which is soon to be put down, or, with the top surface of the pavement that will be put down after grinding takes place.

Figure 3:
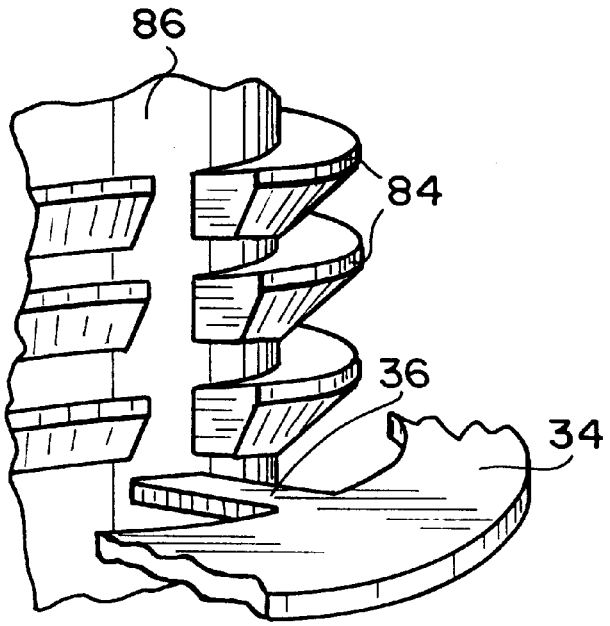
FIG. 3 is a fragmented perspective view of the tongue in groove connection between the end cap and the threaded riser member within the roadway access device according to the present invention.

The externally threaded riser member 80 is fixed relative to the rest of the access device 10 by means of four diametrically opposed fins 82 which extend outwardly perpendicular to the riser member 80 and are covered by sufficiently compacted earth to maintain its position. The threaded riser 80 has twelve (12) inches of threads, nine (9) inches of which screw up into the extension nut 50, which is surrounded by the funnel section 30, but remains free to rotate. The riser member 80 has notches 86 on its outer threaded surface to correspond with the tongues 36 of the end cap 34 as described above and as best seen in FIG. 3. This connection prevents the funnel 20 from rotating during vertical displacement of the access device 10, thereby reducing the amount of friction against the side wall 31 of the funnel section 30. It is through the rotation of the extension nut 50 about the riser member 80 that adjustment is achieved. The purpose of the extension nut 50 and the riser 80 is to provide vertical adjustment means for the access device 10, not to provide support for the valve access device 10 or absorb loads applied by ambient factors. The loads placed on the access device 10 are absorbed by the funnel sidewall 31 bearing upon the fixed material surrounding the riser 80, as will be further described herein below.

Figure 4:
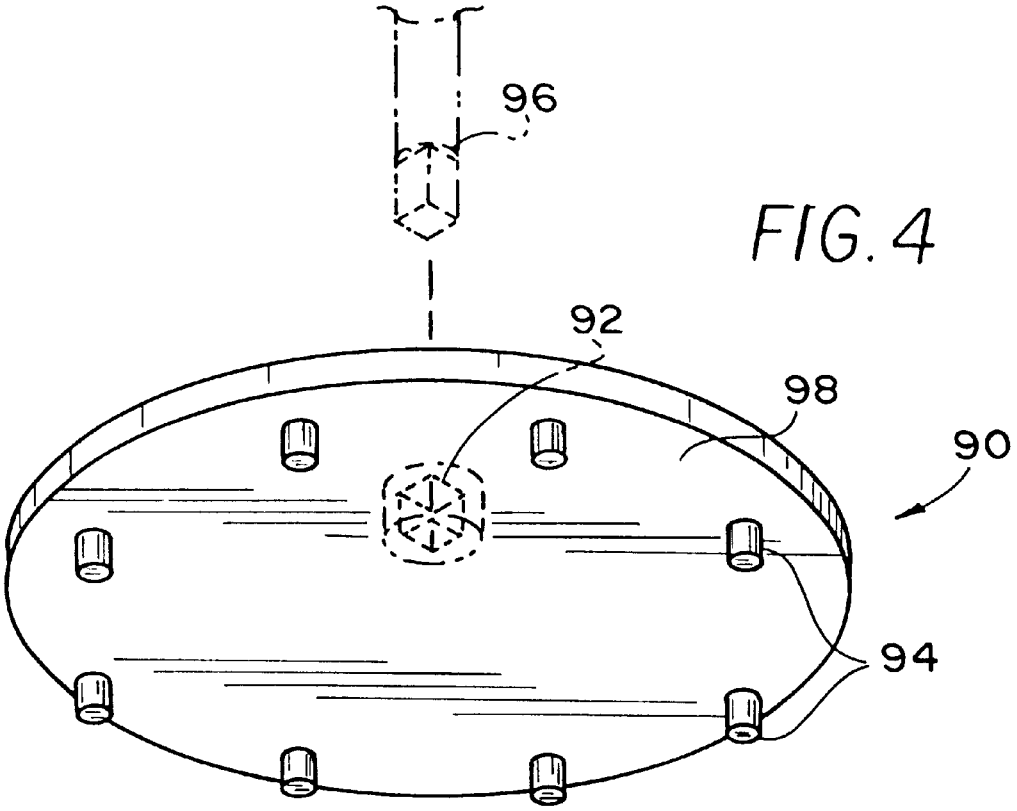
FIG. 4 is a perspective view of an example of a tool usable with the present invention.

By manipulating the access device 10 to position its top edge 39 at various horizontal planes, a user is able to readily accommodate both an initial road installation as well as subsequent resurfacing. In order to vertically displace the access device 10, the extension nut 50 is rotated about the threaded riser member 80 by means of the tool 90 shown in FIG. 4. This tool 90 comprises a typical ratchet type wrench (not shown) attached to an elongated socket 96 which removably couples to a half inch ratchet socket 92 on top of a disc 98 with fixed cylindrical pegs 94 extending downwardly from the bottom surface of the disc 98 and spaced around its circumference. The extension nut 50 wall flares out at its top surface 52 and has a plurality of receptor cavities 56 extending vertically downward from its top surface 52 which correspond to the pegs 94 on the tool 90. There is a continuous rounded groove 57 at the top of the nut driver 54 connecting each receptor cavity 56 to allow for easy placement of the tool 90 into the receptor cavities 56.

Figure 5:
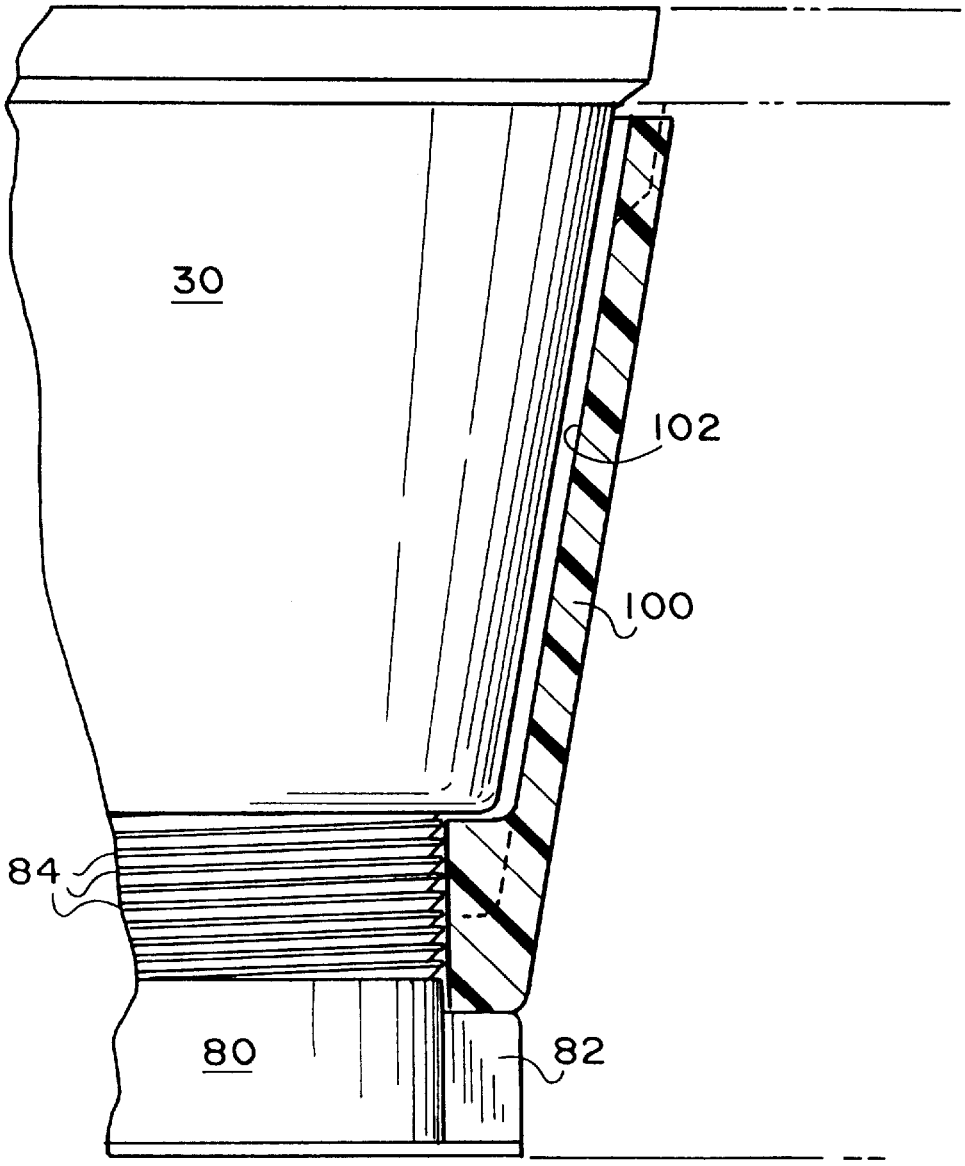
FIG. 5 is a partial side elevation of a roadway access device with an insert in place for support.

In order to raise the access device 10 to its proper height, the funnel 20 must first be completely removed by rotating the extension nut 50 in the appropriate direction. This operation requires little force since the extension nut 50 is internally threaded to avoid friction acting thereon, and the funnel section 30 is being lifted away from the surface it is in contact with. Once the height is determined at which the top edge 39 of the funnel 20 will ultimately remain, an insert 100 is placed in the fixed material surrounding the threaded riser and which was previously in contact with the side wall 31 of the funnel. The inserts 100 are formed to fill the void that is created by the raising of the funnel 20. The inner surface 102 of the insert 100 will conform to the side wall 31 of the funnel. The dashed line in FIG. 5 represents the position of the funnel 20 prior to the resurfacing and placement of the insert 100. Instead of the insert, the void could be filled by a non-shrink quick setting cement grout.

The insert 100 is made of the same material as the rest of the access device 10 and will be able to absorb the loads imparted thereon. The inserts 100 are available in a plurality of sizes in order to accommodate the varying degrees of road height adjustment. Once the insert 100 is in place, the funnel 20 is placed back on the threaded riser member 80 and the extension nut 50 is rotated with the tool 90 until the funnel comes in contact with the insert 100. The use of inserts 100 is more suited to this assembly than using grout because of the expense of the grout and the labor intensive application of the grout. Further, the use of grout involves waiting for the grout to dry and cleaning up the equipment used in preparing the grout. Additionally, once the funnel 20 is lowered on to the insert 100, the paving operation may commence immediately because there is no need to allow for drying time as with the grouting method. The use of inserts 100 is also better suited when grinding operations are to take place since there is no need for time consuming removal of grout from the cavity in order to lower the access device 10 prior to grinding. The insert 100 is simply removed and the grinding cap (discussed below) installed.

The lid 60 of the access device 10 is made from the same material as the access device 10 itself and is comprised of a structural lid member 64 and a lid cover 62. The structural lid member 64 forms a concave shape that has a honeycomb structure to enable it to support greater loads that will be imparted thereon. The structural lid member 64 is removably attached to the lid cover 62 by four stainless steel screws 68. The lid cover 62 absorbs the majority of the wear from natural elements and automobile tires. Once the lid cover 62 begins to wear out, it can be easily replaced without the need to replace the more costly structural lid member 64. There is a rubber seal 28 which is used between the lid 60 and the funnel section 30 in order to provide a watertight seal for the access device 10.

In order to facilitate the removal and replacement of the lid 60, parallel angular ribs 26*a,* 26*b* project from the inclined inner surface 22 of the upper funnel section 30 at three equidistant locations around its circumference. The lid 60 has corresponding ribs on its side wall that slide along the ribs 26*a,* 26*b* which guide the lid 60 in and out of the funnel. To prevent the lid 60 from being inadvertently spun off by a passing vehicle, there is a post 72 protruding from the inner surface 22 of the funnel that acts as a stopping point for a bolt 70 that is screwed in place when the lid 60 is securely in position, thus preventing rotation of the lid 60 in an undesirable fashion.

Figure 8:
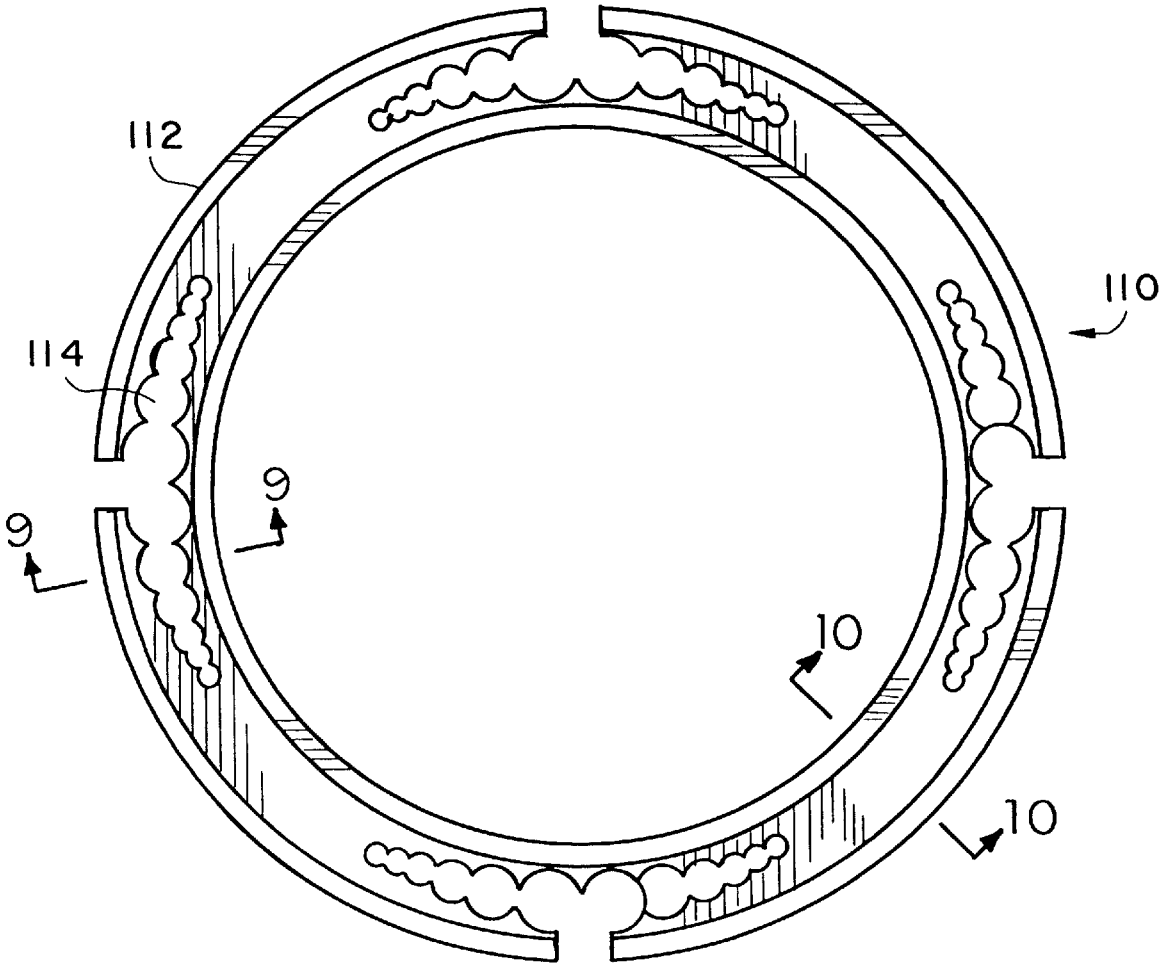
FIG. 8 is a top plan view of a wire ring for use with the present invention.
Figure 10:
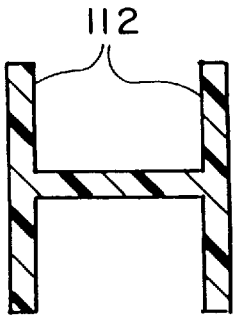
FIG. 10 is a cross section of the wire ring in FIG. 8 along the line 10—10.
Figure 9:
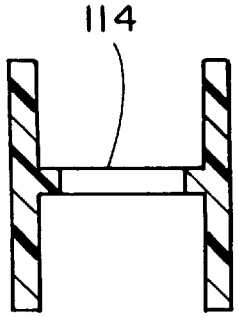
FIG. 9 is a cross section of the wire ring in FIG. 8 along the line 9—9.
Figure 11:
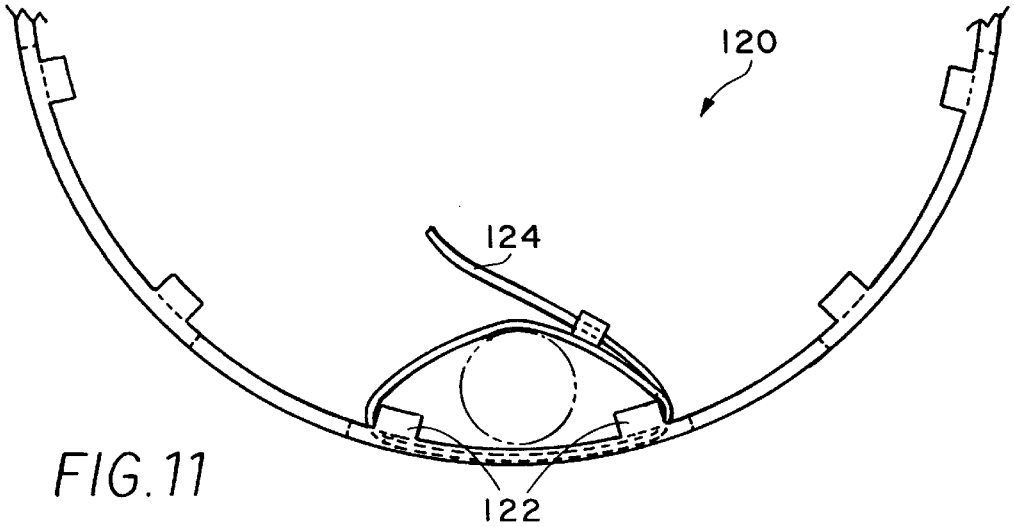
FIG. 11 is a partial top plan view of a second wire ring for use with the present invention.
Figure 12:
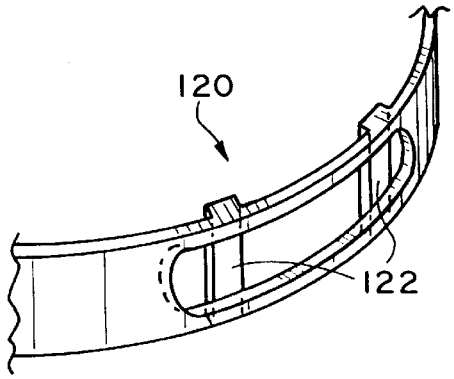
FIG. 12 is a fragmented, perspective view of a section of the wire ring of FIG. 11.

When the access device 10 is a telescopic utility valve box (FIG. 1), in order to secure necessary wires (not shown) such as pipeline location wires and cathodic protection wires, to the inside of the access device 10, two types of wire retaining rings are friction fit to the riser member 80. The first ring 110, FIGS. 8–10 is a flat plastic ring with a cylindrical outer wall 112 which friction fits to the inner surface of the riser member 80. The ring 110 has circular grooves 114 cut out which form a plurality of containment slots for accommodating different sized wires. There are cutouts in the cylindrical outer wall 112 adjacent the circular grooves 114 adapted for receiving the wires prior to installing the ring 110 in place. The second ring 120, FIGS. 11–12, is a cylindrical plastic ring with slats 122 around its circumference adapted for receiving standard wire ties 124 which are used to secure the wires to the circumference of the ring. The ring is friction fit to the inner surface of the riser member 80.

Another feature of the access device 10 embodied as a utility valve box is a means for identification of the valves within the funnel 20. A series of pegs 42 is fixed on the horizontal ledge 24 of the funnel section 30. There are corresponding sleeves 44 which fit around the pegs 42 and contain visible indicia such as letters or numbers and a variety of symbols (FIG. 6B) which can be arranged by the user to identify pipeline pressure, on/off positions, utility pipe directions, and company name. Additionally, there are multipurpose identification tags 46 which are labeled to meet the needs of any utility company. The tags have punchouts 47 which indicate pipe size, type (i.e. plastic or steel), and valve type (i.e. gate, plug, ball). As shown in FIG. 6C, the punchouts 47 are areas along the surface of the plate where the thickness of the plate is minimal to allow for easy removal of a portion of the plate adjacent the visible indicia. The tags are color coded for ease of identification (i.e. yellow to signify gas lines, blue to signify water lines).

Figure 6:
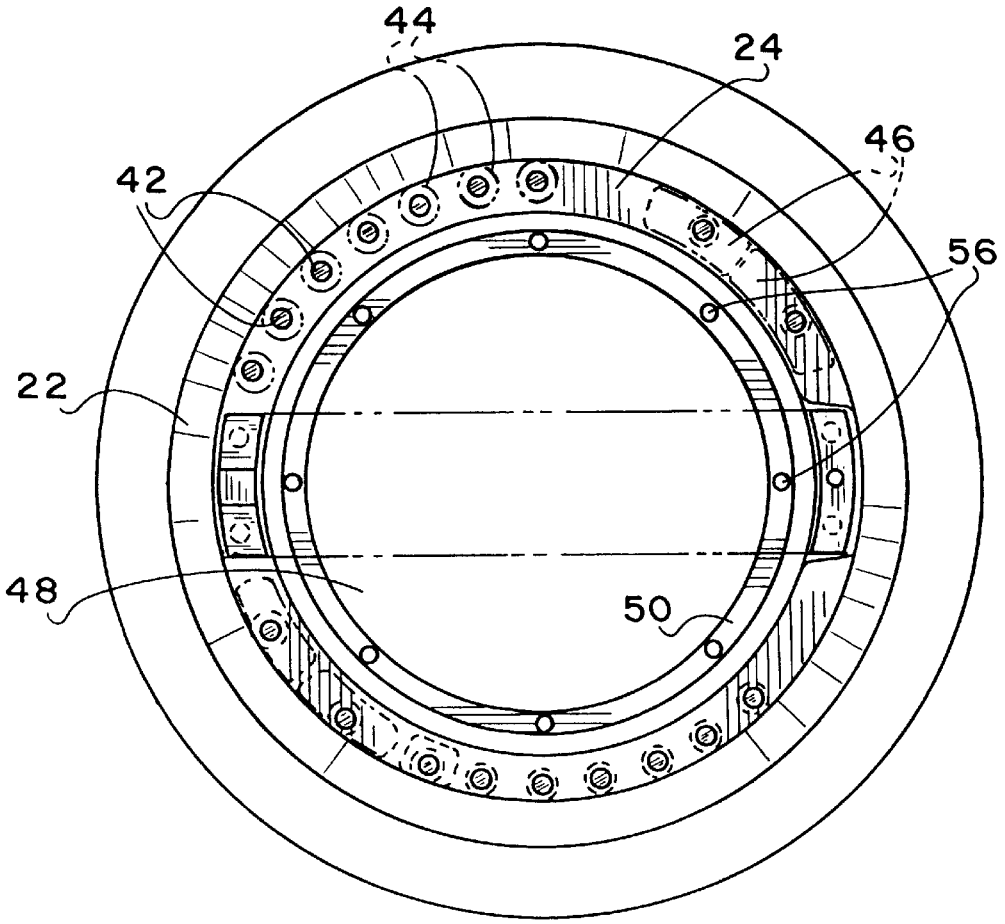
FIG. 6 is a top plan view of the roadway access device of FIG. 2 with identification markings in place.
Figure 6A:
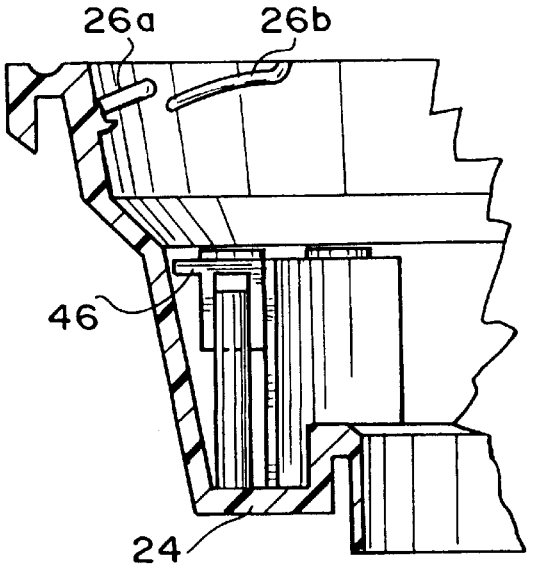
FIG. 6A is a partial, side cross-sectional view of an identification plate.
Figure 6B:
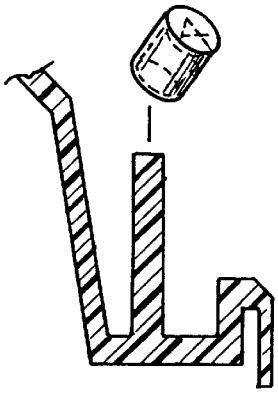
FIG. 6B is a perspective view of the identification pegs and sleeves according to the present invention.
Figure 6C:
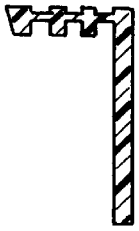
FIG. 6C is a cross-sectional view of an identification plate with punchout areas for identification of pipe specifications.
Figure 6D:
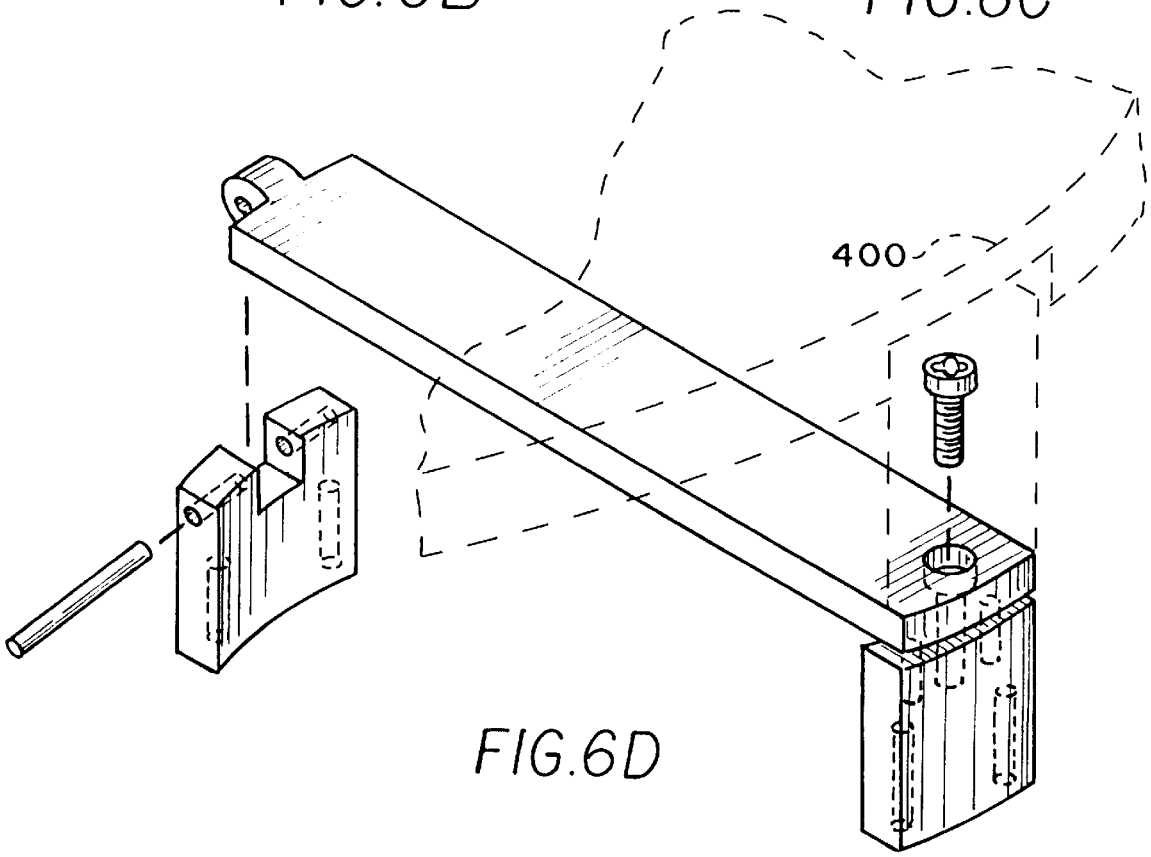
FIG. 6D is a perspective view of the optional lock out strap and lockout disc.

To prevent unwanted access to the utility valve box 10, a durable lock-out strap 48 can be placed over the funnel opening as shown in FIG. 6. The strap 48 is attached to the upper funnel section 30 by a hinge 49 on one end and is removably bolted to the funnel on the opposite end. The screw head 43 is formed in a special shape and can only be opened by a tool with a corresponding shape (not shown). Since the strap 48 only covers part of the opening, access to wiring and sight of the valve is still possible without unlocking the strap. In another embodiment of the invention, the lockout means further comprises a disk 400 which attaches to the strap 48 to provide complete closure of the opening to the valve, as seen in FIG. 6*d.* With the use of the disk, access to the valve can only be accomplished by unlocking the strap. This prevents vandalism of the valve and is an additional instrument for keeping out unwanted debris.

In one embodiment of the invention, the bottom end 33 of the threaded riser 80 is adapted to be coupled to existing valve housings through the use of various couplings (not shown).

In another embodiment the utility valve box 10 is coupled to an extended valve nut adapter 200. The extended valve nut adapter 200 is used in conjunction with an existing valve nut extension 205 which uses a riser tube welded to the top of the utility valve which allows the valve nut 207 to be operated several inches above the valve body through the use of an internal extension bar. When the extended valve nut adapter 200 is utilized, the existing valve nut extension is completely sealed from the damaging effects of natural weathering elements.

The extended valve nut adapter 200 comprises an upper cylindrical coupling member 210 which couples to the bottom end 33 of the threaded riser member 80, a cylindrical receiver member 220 which maintains the utility wires clear of the existing valve nut extension, and a cylindrical spring fit member 230 which supports the weight of the valve box 10 during installation while providing for quick height adjustment by sliding the entire unit up and down the existing valve nut extension until the correct installation height is achieved. All three members of the extended valve nut adapter are removably coupled with one another and are placed over the existing valve nut extension before being coupled to the bottom of the threaded riser.

The upper coupling member 210 comprises an upper coupling section 212 which couples to the threaded riser member 80 and a lower connecting section 214 which couples with the receiver member 220.

Figure 7:
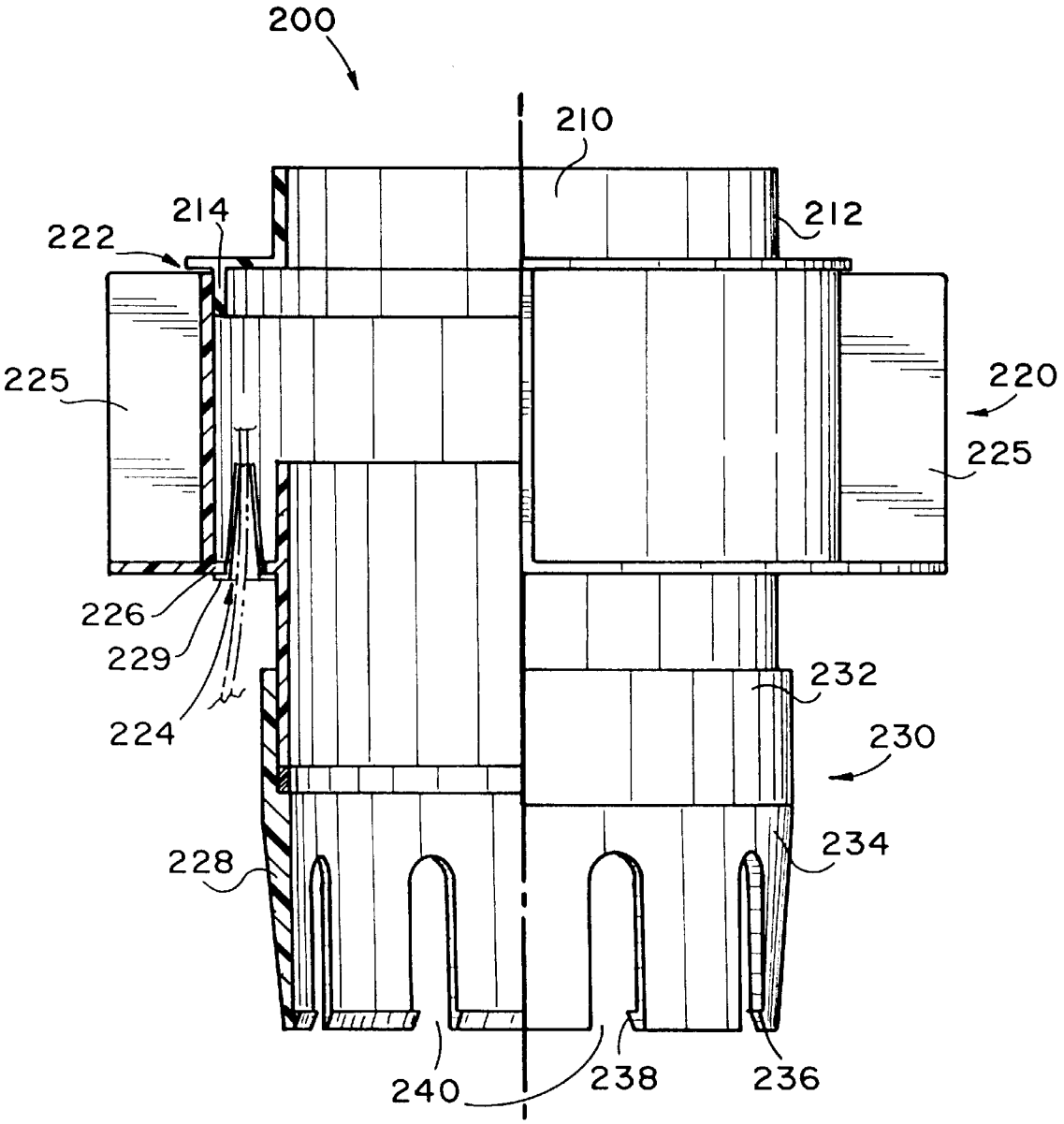
FIG. 7 is a partially sectioned, side elevational view of an extended valve nut adapter.

As seen in FIG. 7, the receiver member 220 comprises a top receiver section 222 which couples with the lower connecting section 214 of the upper coupling member 210 and contains eight punchout circles 224 located around the circumference of an inner ledge 226, and four diametrically opposed fins 225 which extend perpendicular to the outer surface of the receiver member 220 and prevent the extended valve nut adapter from rotating about the existing valve nut extension; and a lower coupling section 228 which couples with the spring fit member 230. The punchout circles 224 in the receiver section 220 are able to receive utility location and cathodic protection wires and the punchouts 224 are sealed through the use of rubber sleeve 229 which fits through the punchout 224 and is sized according to the diameter of the wire to be placed therein.

The spring fit member 230 comprises a top section 232 which is coupled with the lower coupling section 228 of the receiver member 220, and a bottom spring section 234 whose inner diameter is equal to the inner diameter of the lower coupling section 228 of the receiver member 220. The bottom edge 236 of the spring fit member 230 has an angular shape which extends inwardly from the outer surface to the inner surface forming a pointed tip 238 which allows easy placement of the entire extended valve nut adapter 200 on the existing valve nut extension. The bottom spring section 234 has vertical cuts 240 at equidistant locations around its circumference allowing the end of the cylinder to spread when placed over the existing valve nut extension while simultaneously applying pressure inwardly perpendicular to the valve nut extension.

The spring fit member 230 allows the extended valve nut adapter 200 to displace its vertical position while maintaining stability about the valve nut extension. As one can infer from the above discussion, the extended valve nut adapter 200 will not be supporting vehicular load transferred through the access device 10 and any pressure applied thereto. As the roadbed material expands and contracts due to frost heaves in cold climates, the extended valve nut adapter will work with the surrounding soil movement, not against it.

The lid 60 can be replaced with a paving lid 130 prior to paving operations which utilize the method described above in which the access device 10 is raised following the paving operations. The paving lid 130 comprises an upper surface and a lower surface, is constructed from the same high strength materials as the lid, and is structurally similar to the lid. The primary difference between the paving lid 130 and the lid 60 is that the paving lid 130 has a square steel plate 132 embedded in its top surface and there is an internally threaded bore 134 in its center which extends half way into the grinding cap 130, at which point, the bore narrows to a diameter which is capable of receiving a drill bit up to ⅜ inches. There is a brass fitting defining the narrow bore 136, which is not threaded, and acts as a piloting hole and prevents the drill bit 152, which will be used in the paving method described below, from damaging the threaded upper portion of the bore. The threaded bore 134 is capable of coupling with an externally threaded t-shaped handle (not shown) which is used to easily remove and replace the paving lid 130.

Figure 13:
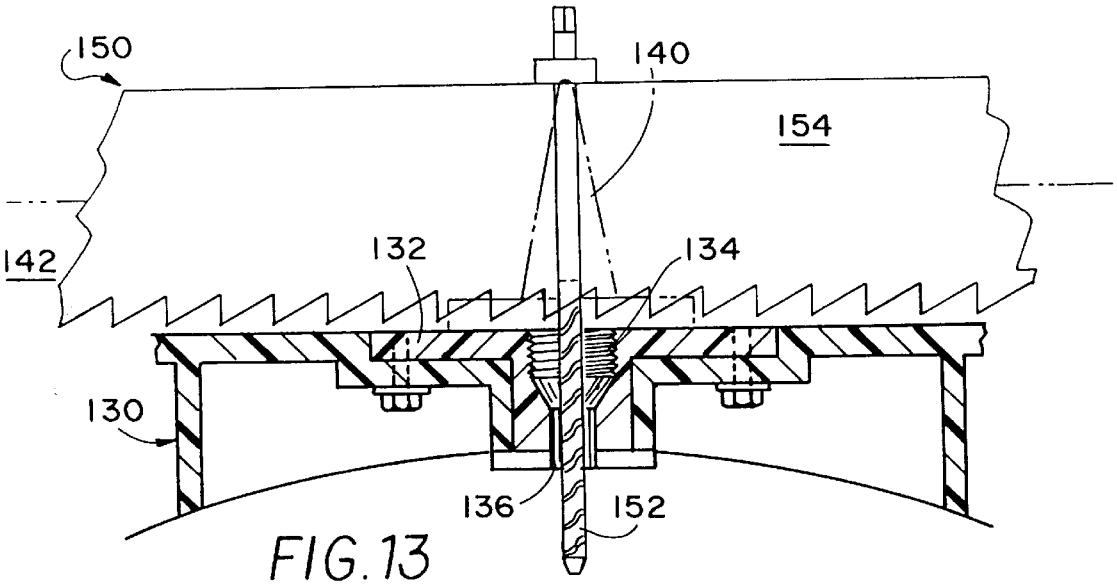
FIG. 13 is a side cross-sectional elevational view of a paving lid for use with the present invention and showing the use of the paving lid for paving operations according to the present invention.

When the paving lid 130 is used for paving operations (FIG. 13), the lid 60 is removed from the access device 10 and the paving lid 130 is put securely in its place. A rubber indicator cone 140 is then placed over the internally threaded bore 134 in the paving lid 130. The new pavement 142 is laid down and the rubber indicator cone 140 is tall enough to remain above the surface of the new pavement 142, advertising the location of the location of the paving lid 130. Upon detection of the appropriate location, the indicator cone 140 is cut to expose the bore 134 in the paving lid 130.

Figure 14:
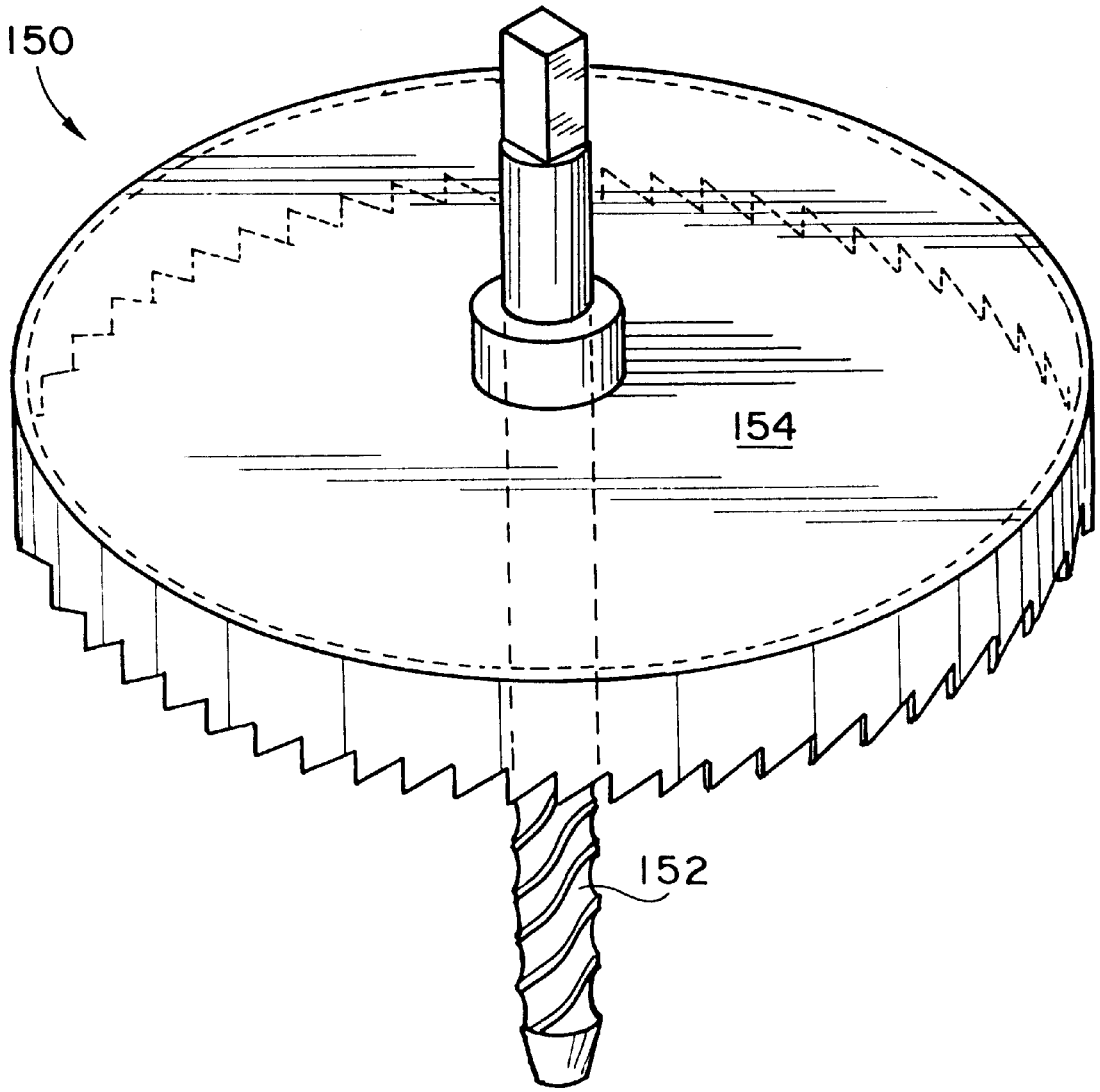
FIG. 14 is a perspective view of a core drilling tool for use with the present invention.

A core drilling machine having a core drilling tool 150, FIG. 14 is used to expose the access device 10. A drill bit 152 is used which will be guided in the lower, piloting hole of the bore 136 and will be coupled with a larger core-drilling bit 154 with a diameter which is ¼" greater than the diameter of the access device lid 60. The core-drilling tool 150 cores through the newly installed asphalt to expose a circular area which is ¼" greater in diameter than the paving lid 130. Once exposed, the paving lid 130 is easily removed by using the t-shaped handle and the funnel 20 can be raised as described above. This method of exposing the access device is accurate and neat, and requires no excess pavement being excavated.

Figure 15A:
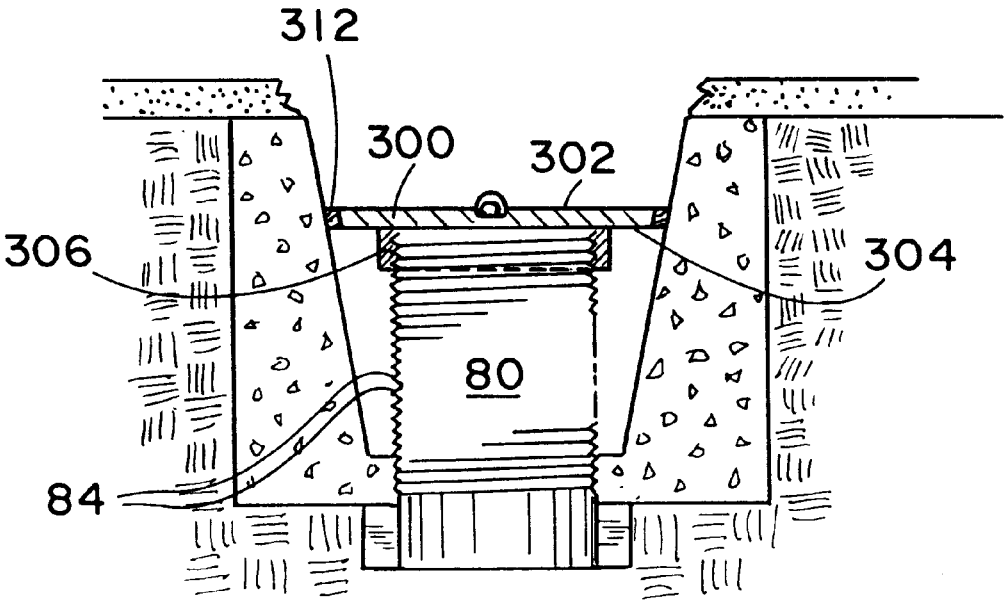
FIG. 15*a* is a perspective view of the grinding cap in place according to the present invention.
Figure 15B:
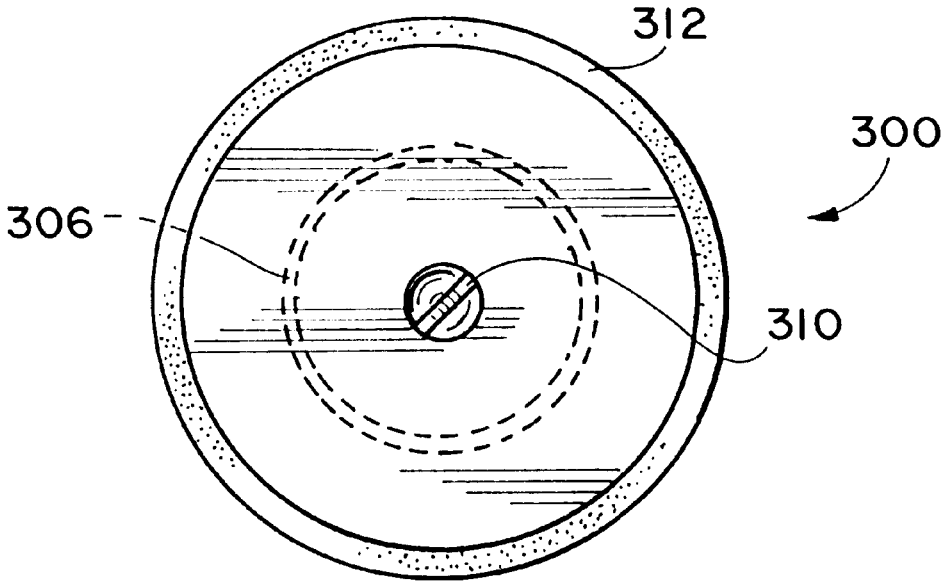
FIG. 15*b* is a top plan view of the grinding cap according to the present invention.

When grinding operations are performed, the funnel 20 is removed completely and the grinding cap 300 is put securely in place over the void left by the funnel 20 as seen in FIG. 15A. The grinding cap 300 comprises a circular disc, having a first end 302 and a second end 304, which is small enough in diameter to fit within the void. There is recessed handle 310 in the center of the grinding cap 300 to allow for easy installation and removal. There is an internally threaded coupling 306 integrally formed on the second end 304 of the grinding cap 300 which engages the threads 84 of the riser member 80. There is a rubber seal 312 provided around the circumference of the grinding cap 300. The grinding cap 300 is well below the surface of where grinding operations will take place and will prevent debris from entering the access device 10. Once the grinding is complete, the excess loose asphalt is removed from the cap 300, and the reusable cap 300 is removed and the funnel 20 is replaced.

It is to be understood that the present invention is not limited to the embodiments described above, but encompasses any and all embodiments within the scope of the following claims.

I claim:

1. A telescopic roadway access device comprising:

a riser assembly having an extension nut and a funnel member surrounding said extension nut, said funnel member defining an interior passageway therein;

said funnel member having an upper funnel section having a side wall terminating in opposing top and bottom surfaces, and an inner and outer surface, and a circular end cap having an inner and outer surface attached to said bottom surface of said upper funnel section with a thrust washer between said bottom surface of said upper funnel section and said circular end cap;

said inner surface of said upper funnel comprising an upper rim with a top and bottom edge, said bottom edge terminating in a horizontal ledge;

said side wall inclined upwardly and outwardly from said bottom surface to said top surface and defining substantially an inverted frustoconical configuration;

said end cap having at least one tongue projecting inwardly perpendicular from said inner surface of said end cap;

said top surface of said upper funnel section forming an inwardly angular seat receiving a circular lid thereon;

said extension nut having a circular wall of some thickness extending in a vertical plane and having an inner and outer surface and top and bottom end, said bottom end of said outer surface provided with internal threads thereon, said thickness of said circular wall being wider at said top end and defining a plurality of tool-engaging receptor cavities therein, a tubular riser member having a circular wall extending in a vertical plane defining an interior passageway therein with a bottom and top end, an inner and outer surface, and provided with external threads thereon engaging with said extension nut internal threads;

said riser member having a plurality of vertical diametrically opposed fins extending outwardly perpendicular from said outer surface of said riser member at said bottom end of said riser member for fixing said riser member in position relative to said riser assembly;

said circular wall of said riser member defining diametrically opposed grooves therein which correspond to said tongues of said end cap, said grooves extending vertically from said top end of said riser member to said bottom end of said riser member on said outer surface of said riser member;

said circular lid removably attachable to said side wall top surface of said upper funnel section and spanning said interior passageway, said lid having a lid cover and a structural lid member removably attached to said lid cover, said structural lid member having an outer edge and a bottom surface forming a concave shape;

a plurality of conical inserts having a side wall and a top and bottom surface, said side wall of said conical inserts inclined upwardly and outwardly from said bottom surface to said top surface of said conical inserts and defining substantially an inverted frustoconical configuration which is concentric with said funnel member, whereby, upon removal of said lid from said side wall top surface of said upper funnel section and insertion of a tool into said receptor cavities of said extension nut, rotation of the tool rotates said extension nut to vertically displace said riser assembly, during which elevation, said rectangular tongues of said end cap slide within said grooves of said riser member.

2. The device according to claim 1 wherein said lid has a honeycomb structure for supporting large loads imparted thereon.

3. The device according to claim 1 further comprising a sealing means for creating a seal between said lid and said side wall top surface of said upper funnel section.

4. The device according to claim 3 wherein said sealing means is a rubber ring.

5. The device according to claim 1 wherein said tongues are two rectangular diametrically opposed tongues.

6. The device of claim 1 wherein said upper funnel section further comprises three sets of parallel angular ribs each extending angularly downward along said upper rim of said inner surface of said funnel section, and a post extending upwardly perpendicular to said horizontal ledge of said inner surface of said funnel section;

said lid further comprising three ridges projecting outwardly from said outer edge of said lid, and a threaded bolt, said sets of ribs engaging said ridges, whereby, upon placing said lid on said funnel member, said ribs angularly guide said lid in place and said threaded bolt is turned in place thereby abutting against said post.

7. A telescopic roadway access device comprising:

a riser assembly having an extension nut and a funnel member surrounding said extension nut, said funnel member defining an interior passageway therein;

said funnel member having an upper funnel section having a side wall terminating in opposing top and bottom surfaces, and an inner and outer surface, and a circular end cap having an inner and outer surface attached to said bottom surface of said upper funnel section with a thrust washer between said bottom surface of said upper funnel section and said circular end cap;

said inner surface of said upper funnel comprising an upper rim with a top and bottom edge, said bottom edge terminating in a horizontal ledge;

said side wall inclined upwardly and outwardly from said bottom surface to said top surface and defining substantially an inverted frustoconical configuration;

said end cap having at least one tongue projecting inwardly perpendicular from said inner surface of said end cap;

said top surface of said upper funnel section forming an inwardly angular seat receiving a circular lid thereon;

said extension nut having a circular wall of some thickness extending in a vertical plane and having an inner and outer surface and top and bottom end, said bottom end of said outer surface provided with internal threads thereon, said thickness of said circular wall being wider at said top end and defining a plurality of tool-engaging receptor cavities therein, a tubular riser member having a circular wall extending in a vertical plane defining an interior passageway therein with a bottom and top end, an inner and outer surface, and provided with external threads thereon engaging with said extension nut internal threads;

said riser member having a plurality of vertical diametrically opposed fins extending outwardly perpendicular from said outer surface of said riser member at said bottom end of said riser member for fixing said riser member in position relative to said riser assembly;

said circular wall of said riser member defining diametrically opposed grooves therein which correspond to said tongues of said end cap, said grooves extending vertically from said top end of said riser member to said bottom end of said riser member on said outer surface of said riser member;

a coupling means for use with an existing valve nut extension;

said circular lid removably attachable to said side wall top surface of said upper funnel section and spanning said interior passageway, said lid having a lid cover and a structural lid member removably attached to said lid cover, said structural lid member having an outer edge and a bottom surface forming a concave shape;

a plurality of conical inserts having a side wall and a top and bottom surface, said side wall of said conical inserts inclined upwardly and outwardly from said bottom surface to said top surface of said conical inserts and defining substantially an inverted frustoconical configuration which is concentric with said funnel member, whereby, upon removal of said lid from said side wall top surface of said upper funnel section and insertion of a tool into said receptor cavities of said extension nut, rotation of the tool rotates said extension nut to vertically displace said riser assembly, during which elevation, said rectangular tongues of said end cap slide within said grooves of said riser member.

8. The device according to claim 7, wherein said coupling means for use with a valve nut extension is an extended valve nut adapter wherein said extended valve nut adapter is comprised of an upper cylindrical coupling member, a cylindrical receiver member, and a cylindrical spring fit member defining an interior passageway therein;

said upper cylindrical coupling member comprising a lower coupling section and an upper coupling section which is coupled with said bottom end of said threaded riser member;

said receiver member comprising a top receiver section which couples with said lower coupling end of said upper coupling member, an integrally formed horizontal inner ledge, four diametrically opposed fins, and an integrally formed lower coupling section;

said horizontal inner ledge having circular punchouts at points around its circumference for receiving wires, wherein said punchouts have a rubber sealing means;

said diametrically opposed fins extending outwardly perpendicular to said top receiver section of said receiver member;

said spring fit member comprising a top section which couples with said lower coupling section of said receiver member, said spring fit member further including an integrally formed spring section having a wall, said wall having an inner and outer surface and a top and bottom end, said wall of said integrally formed spring section being angular at said bottom end extending inwardly from the outer surface to the inner surface of said wall of said integrally formed spring section, vertical cuts in said wall of said integrally formed spring section, whereby the diameter of said bottom end of said spring fit member can expand when placed on said existing valve nut extension.

9. The device according to claim 7 further comprising a valve identification means.

10. The device according to claim 9 wherein said valve identification means comprises a plurality of pegs extending upwardly perpendicular from said horizontal ledge of said inner surface of said upper funnel section and are located around the circumference of said funnel section, a plurality of peg covers which insertably connect with said pegs, and have a top surface, wherein said top surface is marked with visible indicia of numerals, letters, or symbols, a plurality of identification plates each having a top and bottom surface and connection legs which couple with said pegs such that each of said plates is horizontal in the plan view, and punchouts, wherein said top surface is marked adjacent to said punchouts with possible pipe specifications.

11. The device according to claim 7 further comprising a valve box locking means.

12. The device according to claim 11, wherein said valve box locking means comprises a rectangular strap having a hinged end and a free end, said hinged end is hingedly connected to said inner surface of said funnel section and said free end is removably coupled to said inner surface of said funnel section by a bolt having an irregular shape notch for receiving a tool of identical shape.

13. The device according to claim 12, wherein said valve box locking means further comprises a disc which is fixedly coupled to said rectangular strap and spans said interior passageway.

14. The device according to claim 7 further comprising a wire retaining means.

15. The device according to claim 14, wherein said wire retaining means is a plastic ring having a cylindrical outer wall with an outer surface fixed to said inner surface of said riser member, said plastic ring having a plurality of circular holes for receiving wires which can be snapped into place; and said outer wall having cutouts therein adjacent said circular holes.

16. The device according to claim 14, wherein said wire retaining means is a plastic cylinder having a wall with slots located around its circumference for receiving standard plastic wire ties for fastening wires thereto.

17. The device according to claim 7, wherein said lid has a honeycomb structure for supporting large loads imparted thereon.

18. The device according to claim 17 further comprising a sealing means for creating a seal between said lid and said upper funnel section.

19. The device according to claim 18 wherein said sealing means is a rubber ring.

20. The device according to claim 7 wherein said tongues are two rectangular diametrically opposed tongues.

21. The device according to claim 7 wherein said upper funnel section further comprises three sets of parallel angular ribs each extending angularly downward along said upper rim of said inner surface of said funnel section, and a post extending upwardly perpendicular to said horizontal ledge of said inner surface of said funnel section;

said lid further comprising three ridges projecting outwardly from said outer edge of said lid, and a threaded bolt, said sets of ribs engaging said ridges, whereby, upon placing said lid on said funnel member, said ribs angularly guide said lid in place and said threaded bolt is turned in place thereby abutting against said post.

* * * * *